United States Patent [19]

Natsui et al.

[11] 4,434,335

[45] Feb. 28, 1984

[54] COMPRESSED-GAS CIRCUIT INTERRUPTER WITH A HEATER

[75] Inventors: Ken-ichi Natsui; Osamu Koyanagi, both of Hitachi, Japan

[73] Assignee: Hitachi, Ltd., Tokyo, Japan

[21] Appl. No.: 229,064

[22] Filed: Jan. 28, 1981

[30] Foreign Application Priority Data

Jan. 28, 1980 [JP] Japan ..... 55-7839

[51] Int. Cl.[3] ..... H01H 33/57

[52] U.S. Cl. ..... 200/148 E; 200/148 B

[58] Field of Search ..... 200/148 E, 148 B, 148 R

[56] References Cited

U.S. PATENT DOCUMENTS 3,742,169 6/1973 Eggert ..... 200/148 E 4,208,556 6/1980 Patel et al. ..... 200/148 E

*Primary Examiner*—Robert S. Macon

*Attorney, Agent, or Firm*—Antonelli, Terry & Wands

[57] ABSTRACT

A compressed-gas circuit interrupter includes a chamber in which $SF_6$ gas is confined, shield members surrounding arc-extinguishing assemblages and heat transfer members connected to the shield members at their ends. Electric heaters are provided at the outside of the chamber and connected to the heat transfer members for heating the ends thereof.

9 Claims, 2 Drawing Figures

COMPRESSED-GAS CIRCUIT INTERRUPTER WITH A HEATER

BACKGROUND OF THE INVENTION

The present invention relates to a compressed-gas circuit interrupter with a heater for maintaining the temperature of the high-pressure gas above its liquefaction point.

In a compressed-gas circuit interrupter, particularly of the type employing an extremely efficient arc-extinguishing and dielectric gas, such as sulfur-hexafluoride ($SF_6$) gas, it is necessary to maintain the temperature of the high-pressure gas above its liquefaction point. The $SF_6$ gas is suitable for an arc-extinction and insulation of the compressed-gas circuit interrupter. However, the $SF_6$ gas can easily be liquefied.

For instance, the $SF_6$ gas of 20° C. under a gauge pressure of 5 atm starts to liquefy at −33° C. the liquefication of the compressed gas results in lowering its density and deteriorating the insulation and arc-extinction performances.

It is conventional to heat the $SF_6$ gas and prevent it from liquefying. This type of the compressed-gas circuit interrupter is disclosed in, for example, U.S. Pat. No. 3,118,995 to R. G. Colclaser, Jr. et al.

SUMMARY OF THE INVENTION

An object of the present invention is to provide an improved compressed-gas circuit interruptor with a heater for maintaining the temperature of the compressed-gas above it's liquefaction point.

It is another object of the present invention to heat the $SF_6$ gas efficiently and reduce the capacity of the heater.

According to the present invention, a heat-radiation member is disposed in the gas-confining sealed chamber and heated by means of a heat transfer member and a heater. The compressed gas is heated as a result of convection with the heat radiation member.

DESCRIPTION OF THE PREFERRED EMBODIMENT

Figure 1:
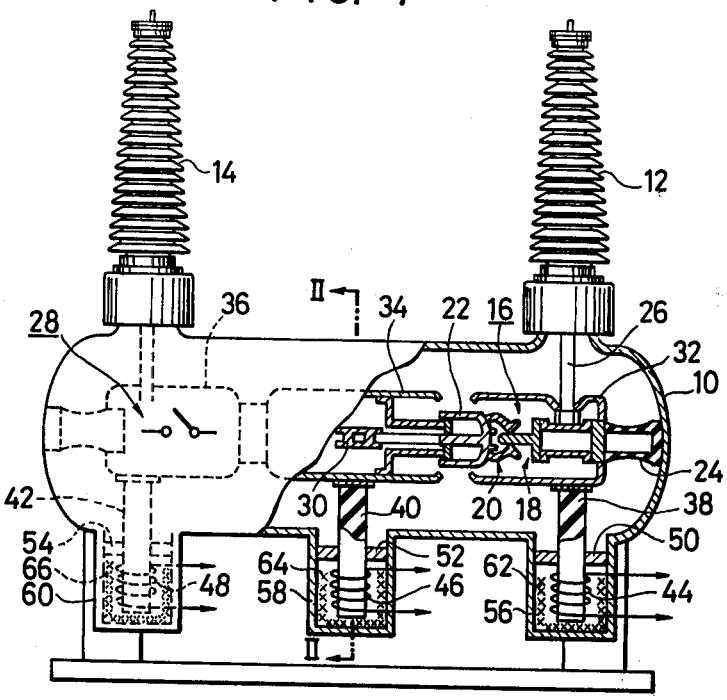
FIG. 1 is a sectional view of the compressed-gas circuit interrupter in accordance with the present invention.
Figure 2:
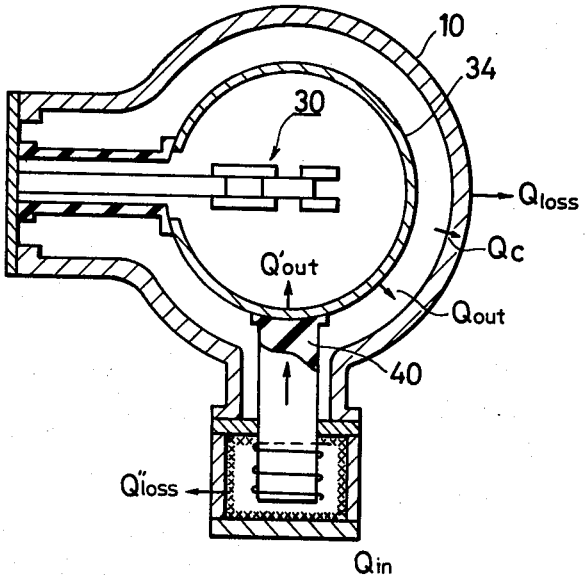
FIG. 2 is a sectional view taken substantially along the line II—II of FIG. 1.

In FIG. 1 and 2, a compressed-$SF_6$ gas is confined in a sealed container or chamber 10. Porcelain bushings 12, 14 are mounted on the chamber 10 and the chamber 10 is maintained at ground potential. An arc-extinguishing assemblage 16 composed of a stationary contact 18, a moving contact 20 and a puffer cylinder 22 is disposed within the chamber 10.

An insulating support 24 fixes the stationary contact 18 to the inner wall of the chamber 10. One end of a conductor 26 is connected to the stationary contact 18 and the other to a suitable electrical apparatus (not shown) through the bushing 12.

Another arc-extinguishing assemblage 28 has same construction as the above assemblage 16. The arc-extinguishing assemblages 16 and 28 are both actuated by means of a link mechanism 30. Disposed interiorly of the chamber 10 and surrounding the arc-extinguishing assemblages 16, 18 and link mechanism 30 are shield members or heat radiating members. The shield members 32, 34, 36 are substantially coaxial with the inner periphery of the sealed chamber 10 to isolate the high-voltage charged portions 16, 28, 30 from the chamber 10. The electric field at the charged portion is relaxed by the shield chambers 32, 34, 36.

Electrically insulating heat transfer members 38, 40, 42 are connected at one end thereof respective to the outer peripheries of the shield members 32, 34, 36 and extended downwardly from the shield members. In order to obtain the high heat transfer efficiency, it is desirable to use a good electric insulating material having a high heat conductivity as large as that of aluminum as the heat transfer members 38, 40, 42. For instance, beryllium oxide (BeO) can be suitably used as the heat transfer members 38, 40, 42.

Heaters 44, 46, 48 provided at the other ends of the heat transfer members 38, 40, 42 heat the heat transfer members 38, 40, 42. The other ends of the heat transfer members 38, 40, 42 are lead out to the outside of the chamber 10 through airtight members 50, 52, 54. The coiled electric heaters 44, 46, 48 are disposed in chambers 56, 58, 60 filled with thermal insulating materials 62, 64, 66.

As shown in FIG. 2, the heat $Q_{IN}$ supplied from the heaters 44, 46, 48 to the heat transfer members 38, 40, 42, except the heat $Q''_{loss}$ lost in the course of heat transfer from the heater, is transmitted to the $SF_6$ gas in the chamber 10. Although a heat $Q_c$ is transferred to the chamber 10 through the $SF_6$ gas, such a heat is extremely small as compared with the heat $Q_{out}$ and $Q_{out}'$ which is transferred from the heat radiating members 32, 34, 36 to the $SF_6$ gas by convection.

Therefore, the heat which is released to the ambient air from the chamber surfaces is negligibly small. According to the present invention, the $SF_6$ gas can be heated with good response to prevent the liquefaction of the $SF_6$ gas, because the gas is heated by the radiation members 32, 34, 36 without heating of the whole chamber 10.

It is possible to effectively heat the gas in the bushings 12, 14, by disposing the heaters 44, 48 beneath the bushings 12, 14 and ensuring a communication between the interiors of the bushings 12, 14 and the chamber 10. In the above construction, the convection of the gas is activated in the chamber 10.

We claim:

1. A compressed-gas circuit interrupter comprising:

a sealed chamber in which a compressed dielectric gas is confined;

an arc-extinguishing assemblage disposed interiorly of said chamber for carrying load current;

a heat radiation member mounted within said chamber for making a heat exchange with the dielectric gas;

a heater disposed at the outside of said chamber; and a heat transfer member connected to said heat radiation member and said heater for transmitting heat generated by said heater to said heat radiation member through heat conduction.

2. A compressed-gas circuit interrupter as claimed in claim 1, wherein said heat transfer member is made of an electric insulating material having a large heat conductivity.

3. A compressed-gas circuit interrupter as claimed in claim 1, wherein said heat transfer member is made of beryllium oxide.

4. A compressed-gas circuit interrupter as claimed in claim 1, wherein said heat radiation member is a cylindrical member surrounding said arc extinguishing assemblage, said heat radiation member being spaced from the inner wall of said chamber.

5. A compressed-gas circuit interrupter comprising:

a sealed chamber in which a compressed sulfur-hexafluoride gas is confined;

a bushing mounted on said sealed chamber;

an arc-extinguishing assemblage disposed interiorly of said sealed chamber for carrying load current;

a shield member surrounding said arc-extinguishing assemblage within said sealed chamber;

a heat transfer member elongated within said sealed chamber, one end of said heat transfer member being connected to said shield member and the other being extended to the outside of said sealed chamber for transferring heat from its one end to the other end through heat conduction;

a heater chamber disposed outside of said sealed chamber and beneath said bushing, and a heater disposed in said heater chamber and coupled to the other end of said heat transfer member.

6. A compressed-gas circuit interrupter comprising:

a sealed chamber in which a compressed dielectric gas is confined;

an arc-extinguishing assemblage disposed within said chamber for carrying load current;

a heat radiation member mounted within said chamber for making a heat exchange with the dielectric gas;

a heater disposed outside of said chamber; and heat transfer means extending between said heat radiation member and said heater for efficiently transferring heat by conduction from said heater to said heat radiation member.

7. A compressed-gas circuit interrupter according to claim 6, wherein said heat transfer means is formed of an electric insulating material having a heat conductivity at least as high as that of aluminum.

8. A compressed gas circuit interrupter according to claim 7, wherein said heat transfer means is formed of beryllium oxide.

9. A compressed-gas circuit interrupter according to claim 6, wherein said heat radiation member is in the form of a shield which surrounds said arc-extinguishing assemblage.

* * * * *